US011859604B2

(12) United States Patent
Cho et al.

(10) Patent No.: US 11,859,604 B2
(45) Date of Patent: Jan. 2, 2024

(54) RECIPROCATING COMPRESSOR

(71) Applicant: LG Electronics Inc., Seoul (KR)

(72) Inventors: Jaeho Cho, Seoul (KR); Sukang Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 336 days.

(21) Appl. No.: 17/384,454

(22) Filed: Jul. 23, 2021

(65) Prior Publication Data

US 2022/0235752 A1 Jul. 28, 2022

(30) Foreign Application Priority Data

Jan. 22, 2021 (KR) ..... 10-2021-0009616

(51) Int. Cl.
*F04B 39/00* (2006.01)
*F04B 39/12* (2006.01)
(Continued)

(52) U.S. Cl.
CPC ..... *F04B 39/0072* (2013.01); *F04B 39/0061* (2013.01); *F04B 39/121* (2013.01);
(Continued)

(58) Field of Classification Search
CPC ..... F04B 39/0061; F04B 39/0072; F04B 39/0055; F04B 39/123; F04B 39/14;
(Continued)

(56) References Cited

U.S. PATENT DOCUMENTS 4,111,278 A * 9/1978 Bergman ..... F01N 1/089 181/255
4,610,604 A * 9/1986 Iwamori ..... F04B 27/1036 417/269

(Continued)

FOREIGN PATENT DOCUMENTS

CN 1963224 5/2007
CN 102362069 2/2012

(Continued)

OTHER PUBLICATIONS

Office Action in Chinese Appln. No. 202111174810.5, dated Apr. 29, 2023, 14 pages (with English translation).

(Continued)

*Primary Examiner* — Dominick L Plakkoottam
(74) *Attorney, Agent, or Firm* — Fish & Richardson P.C.

(57) ABSTRACT

A reciprocating compressor includes a cylinder that defines a compressing space and a discharge muffler configured to receive refrigerant compressed in the cylinder and to discharge the refrigerant. The discharge muffler includes a discharge muffler body and a discharge guide supported by the discharge muffler body. The discharge muffler body defines a discharge space configured to receive the refrigerant from the cylinder and includes a wall protruding from an inner circumferential surface of the discharge muffler body. The discharge guide is coupled to the wall and includes a pipe that defines a pipe inflow hole configured to receive the refrigerant from the discharge space and a pipe outflow hole configured to discharge the refrigerant. The discharge guide further includes a fixing bracket that couples the pipe to the discharge muffler body.

20 Claims, 13 Drawing Sheets

(51) Int. Cl.

| | |
|---|---|
| ***F04B 53/00*** | (2006.01) |
| ***F04B 53/14*** | (2006.01) |
| ***F04B 39/14*** | (2006.01) |

(52) U.S. Cl.
CPC ..... *F04B 39/122* (2013.01); *F04B 39/123* (2013.01); *F04B 39/14* (2013.01); *F04B 53/004* (2013.01); *F04B 53/144* (2013.01)

(58) Field of Classification Search
CPC ..... F04B 39/0027; F04B 39/0066; F04B 53/004; F01N 1/089
See application file for complete search history.

(56) References Cited

U.S. PATENT DOCUMENTS

| | | | | |
|---|---|---|---|---|
| 5,139,392 | A * | 8/1992 | Pettitt | F04B 27/12 417/269 |
| 6,077,049 | A * | 6/2000 | Nakamura | F04B 39/0066 91/499 |
| 10,677,234 | B2 * | 6/2020 | Kim | F04B 39/122 |
| 2002/0017425 | A1 * | 2/2002 | Yoon | F04B 39/0061 181/403 |
| 2005/0006172 | A1 * | 1/2005 | Thomsen | F04B 39/0061 181/229 |
| 2005/0042114 | A1 * | 2/2005 | Seo | F04B 39/0055 417/540 |
| 2011/0014065 | A1 * | 1/2011 | Park | F04B 39/0061 417/312 |
| 2012/0011876 | A1 | 1/2012 | Sata et al. | |
| 2014/0322040 | A1 * | 10/2014 | Cho | F04B 39/0061 417/312 |
| 2015/0176576 | A1 | 6/2015 | Lee et al. | |
| 2016/0131123 | A1 * | 5/2016 | Kim | F04B 39/123 417/312 |
| 2018/0223825 | A1 * | 8/2018 | Cho | F16L 17/063 |

FOREIGN PATENT DOCUMENTS

| | | |
|---|---|---|
| CN | 104121163 | 10/2014 |
| CN | 105587554 | 5/2016 |
| CN | 105688518 | 6/2016 |
| CN | 206770156 | 12/2017 |
| CN | 107762801 | 3/2018 |
| CN | 208106697 | 11/2018 |
| CN | 112005011 | 11/2020 |
| CN | 112177887 | 1/2021 |
| DK | 293684 | 12/1984 |
| EP | 2796716 | 10/2014 |
| JP | 2013231429 | 11/2013 |
| KR | 10-2003-0043018 | 6/2003 |
| KR | 100641122 | 11/2006 |
| KR | 100702988 | 4/2007 |
| KR | 20070105573 | 10/2007 |
| KR | 10-2009-0097041 | 9/2009 |
| KR | 101492342 | 2/2015 |
| KR | 2016005549 8 | 5/2016 |
| KR | 1020160055497 | 5/2016 |
| KR | 2017011795 3 | 10/2017 |
| WO | WO 2007108603 | 9/2007 |

OTHER PUBLICATIONS

Notice of Allowance in Korean Appln. No. 10-2021-0009616, dated Aug. 12, 2022, 4 pages (with English translation).
Extended European Search Report in European Appln. No. 21193214.0, dated Jan. 31, 2022, 4 pages.

* cited by examiner

RECIPROCATING COMPRESSOR

CROSS-REFERENCE TO RELATED APPLICATIONS

This application claims priority to Korean Patent Application No. 10-2021-0009616, filed on Jan. 22, 2021, in Korea, the entire contents of which are hereby incorporated by reference in their entirety.

TECHNICAL FIELD

The present disclosure relates to a reciprocating compressor.

BACKGROUND

A reciprocating compressor is an apparatus that can compress a fluid, for example, by suctioning, compressing, and discharging a refrigerant based on a piston reciprocating in a cylinder. The reciprocating compressor may be classified into a connection type reciprocating compressor and a vibration type reciprocating compressor depending on driving manners of a piston. For instance, the connection type reciprocating compressor may compress a refrigerant based on reciprocation of a piston connected with a rotating shaft of a driving device through a connecting rod. The vibration type reciprocating compressor may compress the refrigerant based on reciprocation of a piston disposed in a cylinder and connected with a mover of a reciprocating motor to vibrate.

In some cases, the connection type reciprocating compressor may include a housing shell having an enclosed space, a driving device provided in the housing shell to provide driving force, a compression device connected with a rotating shaft of the driving device to compress a refrigerant through a reciprocating motion of the piston in the cylinder using the driving force received from the driving device, and a suction and discharge device to suction the refrigerant and to discharge the refrigerant compressed through the reciprocating motion of the compression device.

The suction and discharge device may include a valve assembly to open or close the suction space and the discharge space for the refrigerant, and a suction muffler and a discharge muffler to reduce noise caused in the procedure of opening or closing the valve assembly.

In some cases, the reciprocating compressor may include discharge pressure pulsations generated in the procedure of discharging the compressed refrigerant, and the discharge pressure pulsations cause a refrigerant pipe, which is connected with the compressor, to vibrate thereby totally increasing the noise of home appliances including the compressor.

The reciprocating compressor may be applied to a smaller-size home appliance such as a water purifier. In some cases, the noise caused by the smaller-size home appliance may degrade the reliability for the product.

SUMMARY

The present disclosure describes a reciprocating compressor having an improved inner structure to reduce a pressure pulsation of a refrigerant which is discharged.

For example, the present disclosure describes a reciprocating compressor that can reduce a pressure pulsation by providing a discharge guide device having a discharge fluid passage for a refrigerant, where the discharge fluid passage is defined inside a discharge muffler.

The present disclosure further describes a reciprocating compressor that can reduce a pressure pulsation of a refrigerant by defining a plurality of discharge rooms inside a discharge muffler by a muffler body, a wall, and a discharge guide device of a discharge muffler.

The present disclosure further describes a reciprocating compressor including a discharge guide device fixed inside a discharge muffler and at least one wall to reinforce the stiffness of the discharge muffler.

The present disclosure further describes a reciprocating compressor including a discharge guide device, where a pipe part of the discharge guide device has a bending shape such that a refrigerant discharged from a suction and discharge tank passes through a discharge fluid passage of a discharge guide device in the procedure of being discharged to a discharge part formed at a lower end portion of the discharge muffler.

The present disclosure further describes a reciprocating compressor including a fixing bracket provided in a discharge guide device such that a pipe part is firmly fixed inside a discharge muffler.

According to one aspect of the subject matter described in this application, a reciprocating compressor includes a cylinder that defines a compressing space and a discharge muffler configured to receive refrigerant compressed in the cylinder and to discharge the refrigerant. The discharge muffler includes a discharge muffler body and a discharge guide supported by the discharge muffler body. The discharge muffler body defines a discharge space configured to receive the refrigerant from the cylinder and includes a wall protruding from an inner circumferential surface of the discharge muffler body. The discharge guide is coupled to the wall and includes a pipe that defines a pipe inflow hole configured to receive the refrigerant from the discharge space and a pipe outflow hole configured to discharge the refrigerant. The discharge guide further includes a fixing bracket that couples the pipe to the discharge muffler body.

Implementations according to this aspect can include one or more of the following features. For example, the pipe can include a first pipe part that extends in a first direction and a second pipe part that extends from the first pipe part in a second direction that is different from the first direction. In some implementations, the discharge muffler body can define a discharge guide hole configured to introduce the refrigerant from the cylinder into the discharge muffler, where the pipe inflow hole is defined at the first pipe part and faces the discharge guide hole.

In some implementations, the discharge muffler body can further define a discharge part configured to discharge the refrigerant from the discharge muffler, where the pipe outflow hole is defined at the second pipe part and faces the discharge part. In some examples, the first direction is a vertical direction, and the second direction is a horizontal direction, where the discharge guide hole is spaced apart from the discharge part and defined above the discharge part in the vertical direction.

In some implementations, the fixing bracket can include a bracket body that defines an insertion groove coupled to the wall and has at least one stepwise section supported by the discharge muffler body. For instance, the at least one stepwise section can include a first stepwise section recessed from an outer surface of the bracket body, where the first stepwise section defines a first step width that is less than an outer width of the bracket body, and a second stepwise section recessed relative to the first stepwise section, where the second stepwise section defines a second step width that is less than the first step width.

In some examples, the discharge muffler body can include an inner wall that is spaced apart from an outer surface of the discharge muffler body and that includes a first jaw that supports the first stepwise section. The discharge muffler body can further include a wall protrusion part that is stepped inward relative to the inner wall, where the wall protrusion part includes a second jaw that supports the second stepwise section.

In some implementations, the reciprocating compressor can further include a tank that is disposed at one side of the cylinder and defines a discharge chamber configured to receive the refrigerant from the cylinder and to supply the refrigerant to the discharge space, where the discharge chamber has a primary discharge room configured to carry the refrigerant received from the cylinder. In some examples, the wall can divide the discharge space into one or more discharge rooms that are configured to receive the refrigerant from the primary discharge room.

In some implementations, the wall can include a first wall and a second wall that are spaced apart from each other, where the first wall and the second wall divide the discharge space into a plurality of discharge rooms that are configured to carry the refrigerant received from the cylinder. For example, the plurality of discharge rooms can include a secondary discharge room defined between the first wall and the discharge muffler body. In some examples, the plurality of discharge rooms can further include a tertiary discharge room defined between the second wall and the discharge muffler body and a quaternary discharge room defined between the first wall and the second wall, where the quaternary discharge room is in fluid communication with the tertiary discharge room. In some examples, the first wall separates the secondary discharge room from the quaternary discharge room.

In some implementations, the discharge muffler body can include a first muffler body that defines a discharge guide hole configured to introduce the refrigerant from the cylinder into the discharge muffler and a second muffler body that is coupled to the first muffler body and defines a discharge part configured to discharge the refrigerant from the discharge muffler, where the second muffler body has a bottom surface that supports the discharge guide.

In some implementations, the reciprocating compressor can include a tank disposed between the cylinder and the discharge muffler, where the tank defines a discharge chamber configured to receive the refrigerant from the cylinder and to discharge the refrigerant to the discharge space. The reciprocating compressor can further include a suction muffler disposed at one side of the tank and configured to supply the refrigerant to the tank. In some examples, the tank can be disposed between the suction muffler and the discharge muffler, where the tank faces the cylinder and connects the suction muffler to the discharge muffler.

In some examples, the tank can further define a suction chamber configured to receive the refrigerant from the suction muffler and to supply the refrigerant to the cylinder.

In some implementations, the reciprocating compressor can further include a shell that defines an enclosed space that accommodates the cylinder, the discharge muffler, the suction muffler, the tank, and the refrigerant, where the suction muffler defines a suction hole configured to introduce the refrigerant in the enclosed space into the suction muffler. In some examples, the suction muffler can further define a suction guide hole configured to supply the refrigerant in the suction muffler to the cylinder.

In some implementations, the inner structure of the discharge muffler can be improved to reduce the pressure pulsation of the refrigerant which is discharged.

In some implementations, the pressure pulsation can be reduced by providing the discharge guide device having the discharge fluid passage for a refrigerant, which is formed inside the discharge muffler.

In some implementations, the pressure pulsation of the refrigerant can be reduced by defining the plurality of discharge rooms inside the discharge muffler by the muffler body, the wall, and the discharge guide device of the discharge muffler.

In some implementations, at least one wall is included inside the discharge muffler, such that the discharge guide device can be firmly fixed inside the discharge muffler and the stiffness of the discharge muffler can be reinforced.

In some implementations, the pipe part of the discharge guide device is configured to have the bending shape, such that the refrigerant discharged from the suction and discharge tank easily passes through the discharge fluid passage of the discharge guide device in the procedure of being discharged to the discharge part formed at the lower end portion of the discharge muffler.

In some implementations, the fixing bracket can be provided in the discharge guide device such that the pipe part is firmly fixed inside the discharge muffler.

BRIEF DESCRIPTION OF THE DRAWINGS

The present disclosure will become more fully understood from the detailed description given herein below and the accompanying drawings, which are given by illustration only, and thus are not limitative of the present disclosure.

DETAILED DESCRIPTION

Hereinafter, exemplary embodiments of the present disclosure will be described in detail with reference to accompanying drawings, such that those skilled in the art can more apparently understand the present disclosure. It should be understood that the exemplary embodiments herein are provided only for the illustrative purpose, and various modifications of the embodiments are reproduced. In addition, the shapes and the sizes of elements in accompanying drawings will be exaggerated for more apparent description.

Figure 1:
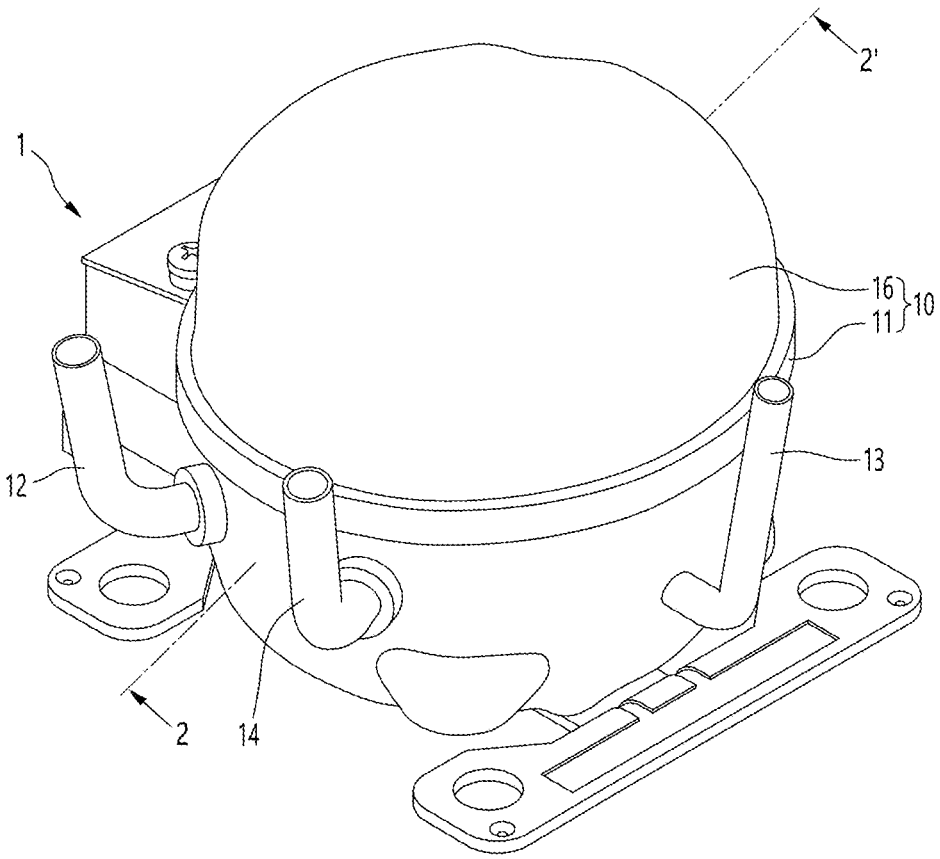
FIG. 1 is a perspective view showing an example of a reciprocating compressor.
Figure 2:
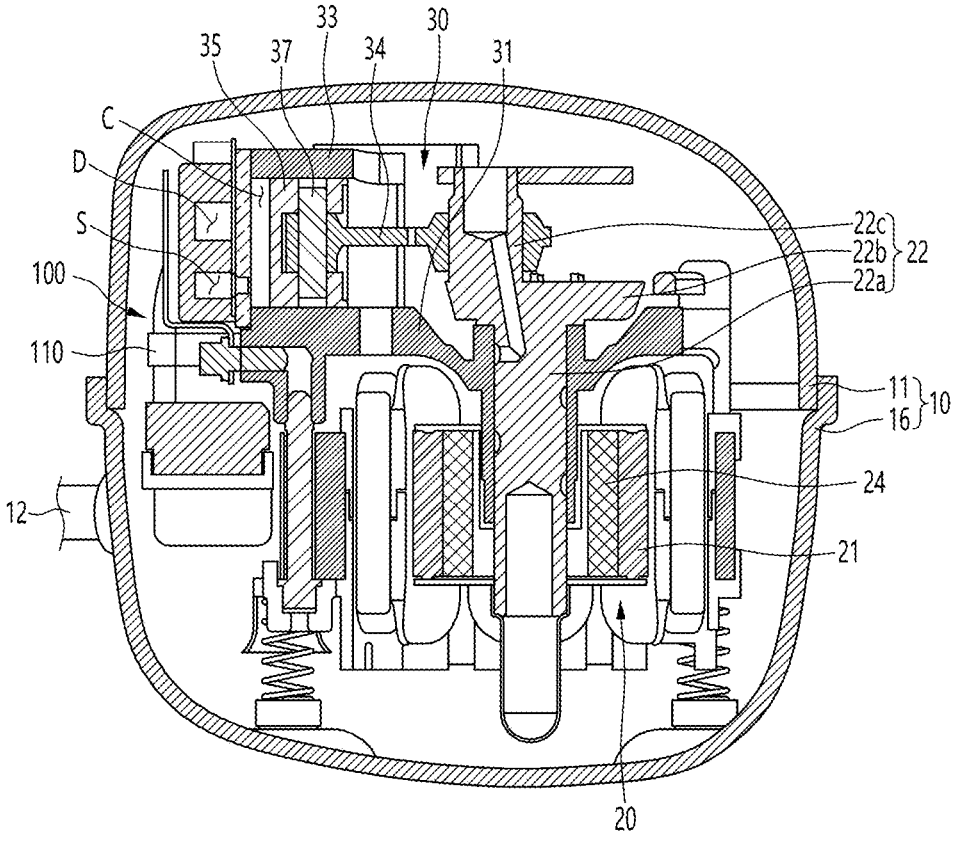
FIG. 2 is a cross sectional view taken along line 2-2' of FIG. 1.

FIG. 1 is a perspective view illustrating an example of a reciprocating compressor, and FIG. 2 is a cross sectional view taken along line 2-2' of FIG. 1.

Referring to FIGS. 1 and 2, a reciprocating compressor 1 can include a shell 10 forming an outer appearance of the reciprocating compressor 1. An enclosed space can be formed inside the shell 10, and various components constituting the reciprocating compressor 1 can be received in the enclosed space. The shell 10 can be formed a metallic material.

A cavity can be formed in an inner space of the shell 10 to define the resonance frequency of the refrigerant. In some implementations, a structure of reducing noise caused in a cavity resonance frequency band of the refrigerant can be provided.

The shell 10 includes a lower shell 11 and an upper shell 16 provided at an upper side of the lower shell 11. In detail, the lower shell 11 has a substantially hemispherical shape and forms a receiving space to receive various components, for example, a driving device 20, a compressing device 30, and a suction and discharge device 100, together with the upper shell 16. The lower shell 11 can be referred to as a "compressor body" and the upper shell 16 can be referred to as a "compressor cover."

The lower shell 11 includes a suction pipe 12, a discharge pipe 13, a process pipe 14, and a power supply. The suction pipe 12 is used to introduce a refrigerant into the shell 10, and is mounted through the lower shell 11. The suction pipe 12 can be mounted separately from the lower shell 11 or can be integrally formed with the lower shell 11.

The discharge pipe 13 is used to discharge the refrigerant, which is compressed in the shell 10, and is mounted through the lower shell 11. The discharge pipe 13 can be separately mounted separately from the lower shell 11 or can be integrally formed with the lower shell 11.

A discharge hose 60 (see FIG. 3) is connected with the discharge pipe 13. The refrigerant, which is introduced into the suction pipe 12 and compressed by the compressing device 30, can be discharged to the discharge pipe 13 through the suction and discharge device 100 and the discharge hose 60.

The process pipe 14, which is a device provided to fill the refrigerant into the shell 10 after the inner portion of the shell 10 is sealed, can be mounted through the lower shell 11.

The driving device 20 is provided in the inner space of the shell 10 to provide driving force. The driving device 20 can include a stator 21, a rotor 24, and a rotating shaft 22. The stator 21 includes a stator core and a coil coupled to the stator core.

When power is applied to the coil, the coil generates electromagnetic force to perform electromagnetic interaction with the stator core and the rotor. Accordingly, the driving device 20 can generate driving force for a reciprocating motion of the compressing device 30.

The rotor 24 has a magnet, and is rotatably provided inside the coil. The rotational force resulting from the rotation of the rotor 24 acts as driving force for driving the compressing device 20.

The rotating shaft 22 can rotate together with the rotor 24, and can be mounted through an inner portion of the rotor 24 in a vertical direction. In addition, the rotating shaft 22 is connected to a connecting rod 34 to transmit the rotational force generated by the rotor 24 to the compressing device 30

In detail, the rotating shaft 22 can include a base shaft 22*a*, a rotational plate 22*b*, and an eccentric shaft 22*c*.

The base shaft 22*a* is mounted inside the rotor 24 in the vertical direction. When the rotor 24 rotates, the base shaft 22*a* can be rotated together with the rotor 24. The rotational plate 22*b* can be installed on one side of the base shaft 22*a*, and can be rotatably mounted to a cylinder block 31 to be described later.

The eccentric shaft 22*c* protrudes upward from a position eccentric from the axial center of the base shaft 22*a* to eccentrically rotate when the rotational plate 22*b* rotates. A connecting rod 34 is mounted on the eccentric shaft 22*c*. As the eccentric shaft 22*c* eccentrically rotates, the connecting rod 34 can linearly reciprocate (a linear reciprocation motion) in a front-rear direction.

The compressing device 30 receives the driving force from the driving device 20 to compress the refrigerant through linear reciprocation motion. The compressing device 30 can include a cylinder block 31, a connecting rod 34, a piston 35, and a piston pin 37.

The cylinder block 31 is provided above the rotor 24. In addition, the cylinder block 31 has a shaft opening such that the rotating shaft 22 passes through the shaft opening. A lower portion of the cylinder block 31 can rotatably support the rotational plate 22*b*.

The cylinder 33 is provided at a front portion of the cylinder block 31 and arranged to receive the piston 35. The piston 35 reciprocates in the front-rear direction, and a compressing space "C" for compressing the refrigerant is formed inside the cylinder 33.

The connecting rod 34 is a device for transmitting the driving force, which is provided from the driving device 20, to the piston 35, and converts the rotational motion of the rotating shaft 22 into the linear reciprocation motion. In detail, the connecting rod 34 linearly reciprocates in the front-rear direction when the rotating shaft 22 rotates.

The piston 35 is a device for compressing the refrigerant, and is provided in the cylinder 33. The piston 35 is connected with the connecting rod 34 and linearly reciprocates in the cylinder 33, as the connecting rod 34 moves. The refrigerant introduced from the suction pipe 12 can be compressed in the cylinder 33, as the piston 35 linearly reciprocates.

The piston pin 37 couples the piston 35 and the connecting rod 34. In detail, the piston pin 37 can connect the piston 35 with the connecting rod 34 by passing through the piston 35 and the connecting rod 34 in the vertical direction.

The suction and discharge device 100 is configured to suction the refrigerant to be supplied to the compressing device 30 and to discharge the compressed refrigerant from the compressing device 30. The suction and discharge device 100 can include a muffler assembly 110 and a discharge hose 60.

The muffler assembly 110 transfers the suctioned refrigerant, which is received from the suction pipe 12, into the cylinder 33, and transfers the refrigerant, which is compressed in the compressing space "C' of the cylinder 33, to the discharge pipe 13. To this end, the muffler assembly 110 has a suction space "S" for receiving the suctioned refrigerant from the suction pipe 12 and a discharge space "D" for receiving the refrigerant compressed in the compressing space C of the cylinder 33.

In detail, the suctioned refrigerant from the suction pipe 12 can be introduced into the suction space "S" of a suction and discharge tank (or a tank) 120 through suction mufflers 130 and 140. The refrigerant compressed in the cylinder 33 passes through discharge mufflers 150 and 160 through the discharge space "D" of the suction and discharge tank 120, and is discharged of the compressor 1 through the discharge hose 60 and the discharge pipe 13. For example, the suction mufflers 130 and 140 and the discharge mufflers 150 and 160 can be cases, containers, or reservoirs that define inner spaces configured to accommodate and guide the refrigerant.

The discharge hose 60 is a device to transfer the compressed refrigerant, which is contained in the discharge space "D," to the discharge pipe 13, and is integrally formed with a second discharge muffler part 160 of the discharge mufflers 150 and 160. In detail, one portion of the discharge hose 60 can be coupled to the second discharge muffler part 160 to communicate with the discharge space "D," or can be formed integrally with the second discharge muffler part 160.

An opposite portion of the discharge hose 60 is coupled to the discharge pipe 13 through a connector 65. The discharge hose 60 and the connector 65 can be jointed to each other or can be formed integrally with each other.

The connector 65 has a plurality of grooves, and ring members 66*a* and 66*b* can be installed in the plurality of grooves, respectively. The ring members 66*a* and 66*b* can be formed of rubber or synthetic resin material.

Figure 3:
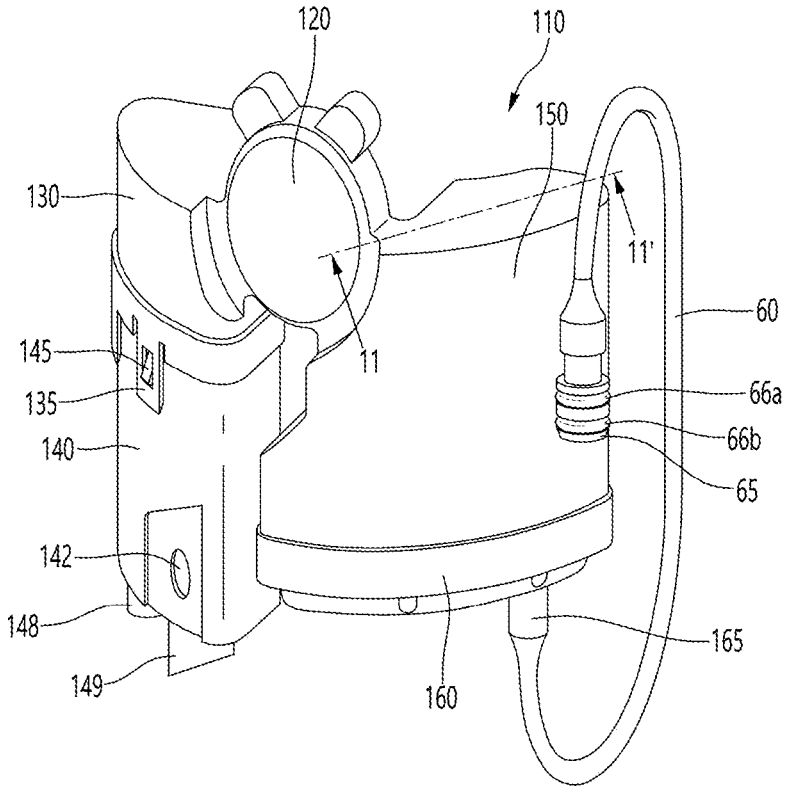
FIG. 3 is a perspective view illustrating an example of a muffler assembly.
Figure 4:
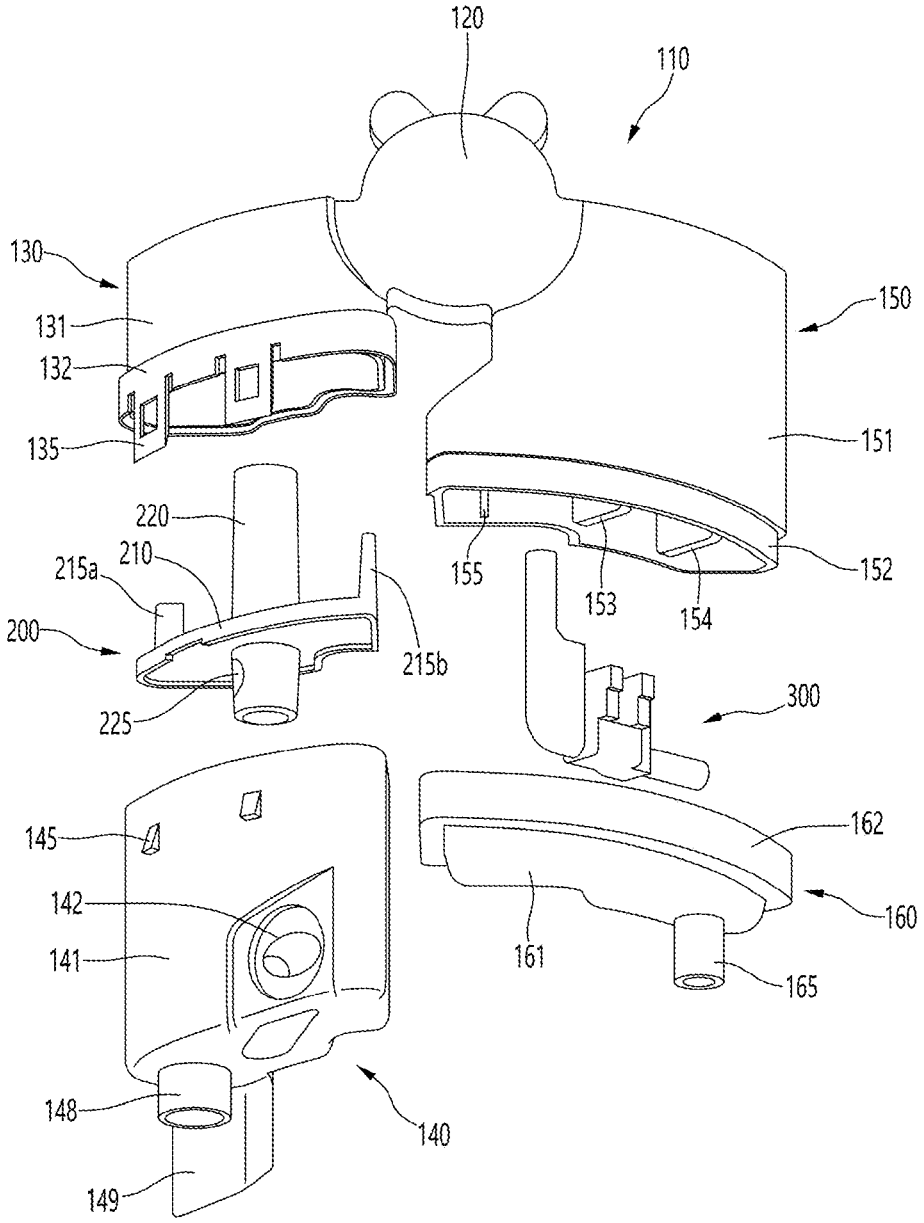
FIG. 4 is a front exploded perspective view illustrating the muffler assembly.
Figure 5:
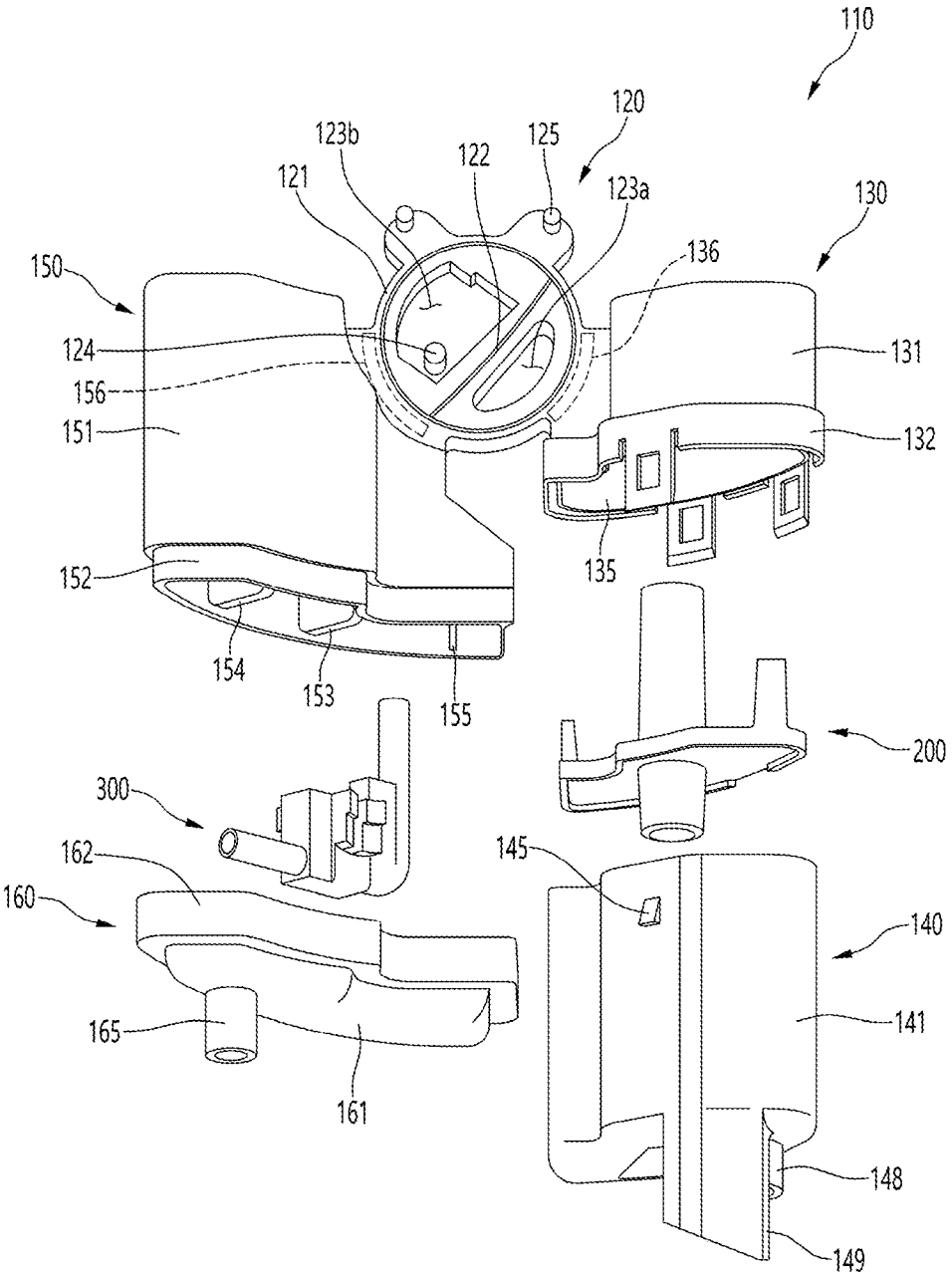
FIG. 5 is a perspective view illustrating the muffler assembly.

FIG. 3 is a perspective view illustrating an example configuration of the muffler assembly, FIG. 4 is a front exploded perspective view illustrating an example configuration of the muffler assembly, and FIG. 5 is a perspective view illustrating an example configuration of the muffler assembly.

Referring to FIGS. 3 to 5, the muffler assembly 110 can include a first suction muffler part 130 and a second suction muffler part 140 constituting the suction muffler.

The first suction muffler part 130 and the second suction muffler part 140 can be assembled, and a refrigerant suction space (or a suction fluid passage) can be defined inside the first and second suction mufflers 130 and 140 through the assembling between the first suction muffler part 130 and the second suction muffler part 140.

When viewed based on FIG. 3, the first suction muffler part 130 can be coupled to an upper side of the second suction muffler part 140. For example, the first suction muffler part 130 can include a hook 135, and the second suction muffler part 140 can include a hook protrusion 145 coupled to the hook 135.

Unlike the drawings, the hook protrusion can be provided on the first suction muffler part 130, and the hook coupled to the hook protrusion can be provided on the second suction muffler part 140.

The first suction muffler part 130 can include a first muffler body 131 including a suction guide hole 136. An end portion of the first muffler body 131 can be open.

A first muffler flange 132 coupled to the second suction muffler part 140 can be provided on the first muffler body 131. The first muffler flange 132 can be formed to be stepped from the first muffler body 131 such that an outer diameter of the first muffler flange 132 is greater than an outer diameter of the first muffler body 131.

The first muffler flange 132 can be coupled to an open end portion of the second discharge muffler part 160. For example, the first muffler flange 132 can be coupled to an outer portion of the second discharge muffler part 160.

The second suction muffler part 140 can include a second muffler body 141 having a suction hole 142 communicating with the suction pipe 12.

The combination of the first muffler body 131 of the first suction muffler part 130 and the second muffler body 141 of the second suction muffler part 140 can be collectively referred to as a "suction muffler body."

The suction hole 142 can be formed through a portion of an outer circumferential surface of the second muffler body 141. In addition, the suction hole 142 is positioned adjacent to the inside of one point of the lower shell 11 to which the suction pipe 12 is coupled.

The second suction muffler part 140 can include an oil drain part 148 such that oil separated from the refrigerant in the inner space of the suction mufflers 130 and 140 is discharged into the inner space of the shell 10. The oil drain part 148 can protrude downward from a bottom surface of the second muffler body 141.

The second suction muffler part 140 can further include a skirt 149 protruding downward from the bottom surface of the second muffler body 141 to prevent the oil discharged from the oil drain part 148 from scattering. The skirt 149 can be provided adjacent to the oil drain part 148.

The suction and discharge tank 120 is connected to one side of the first suction muffler part 130. For example, the first suction muffler part 130 and the suction and discharge tank 120 can be integrally formed.

The discharge mufflers 150 and 160 can be provided in opposition to each other based on the suction and discharge tank 120.

In detail, the first discharge muffler part 150 of the discharge muffler can be spaced apart from one side of the first suction muffler part 130. The suction and discharge tank 120 having the suction space "S" and the discharge space "D" are mounted between the first suction muffler part 130 and the first discharge muffler part 150.

The first suction muffler part 130, the suction and discharge tank 120, and the first discharge muffler part 150 can be integrally configured. The first suction muffler part 130, the suction and discharge tank 120, and the first discharge muffler part 150 can be collectively named a "tank assembly."

The first suction muffler part 130, the suction and discharge tank 120, and the first discharge muffler part 150 can be formed of the same material, for example, of a nylon material having higher pressure resistance.

The suction and discharge tank 120 can include a tank body 121 having a suction and discharge space. For example, the tank body 121 can have a cylindrical shape.

A suction chamber 123*a* and a discharge chamber 123*b* can be formed inside the tank body 121. The suction chamber 123*a* can have the suction space "S," and the discharge chamber 123*b* can have the discharge space "D"

The suction chamber 123*a* and the discharge chamber 123*b* can be formed to be recessed in a surface facing the valve assembly.

The suction chamber 123*a* can be configured to communicate with the suction guide hole 136 of the first suction muffler part 130. The suction guide hole 136 can be formed in the connection part between the suction and discharge tank 120 and the first suction muffler part 130. For example, the suction guide hole 136 can be formed in one side of an outer circumferential surface of the suction and discharge tank 120.

The discharge chamber 123*b* can be configured to communicate with the discharge guide hole 156 of the first discharge muffler part 150. The discharge guide hole 156 can be formed in the connection part between the suction and discharge tank 120 and the first discharge muffler part 150. For example, the discharge guide hole 156 can be formed in an opposite side of an outer circumferential surface of the suction and discharge tank 120.

The suction and discharge tank 120 can include a partition part 122 to partition the inner space of the suction and discharge tank 120 into the suction chamber 123*a* and the discharge chamber 123*b*. The valve assembly can be installed at one side of the suction and discharge tank 120. The valve assembly can include a suction valve to open and close the suction chamber 123*a* and a discharge valve to open and close the discharge chamber 123*b*.

A retainer 124 can be provided in the discharge chamber 133*b* to limit the opening amount of the discharge valve. The retainer 124 can protrude from the bottom surface of the discharge chamber 133*b* and be disposed adjacent to the discharge guide hole 156.

The suction and discharge tank 120 can further include a sealing protrusion 125 to which a sealing member is coupled.

The second discharge muffler part 160 of the discharge muffler can be assembled with the first discharge muffler part 150, and a discharge space (or a discharge fluid passage) for the refrigerant can be defined inside the first and second discharge mufflers 150 and 160 through the assembling.

When viewed based on FIG. 3, the first discharge muffler part 150 can be coupled to an upper side of the second discharge muffler part 160.

The first discharge muffler part 150 can include a first muffler body 151 including a discharge guide hole 156. An end portion of the first muffler body 151 can be open.

A first muffler flange 152 coupled to the second discharge muffler part 160 can be provided on the first muffler body 151. The first muffler flange 152 can be formed to be stepped from the first muffler body 151 such that an outer diameter of the first muffler flange 132 is greater than an outer diameter of the first muffler body 151. The first muffler flange 152 can be inserted into an open end portion of the second discharge muffler part 160.

The second discharge muffler part 160 can include a second muffler body 161 having a discharge part 165 coupled to the discharge hose 60.

The first muffler body 151 of the first discharge muffler part 150 and the second muffler body 161 of the second discharge muffler part 160 can be collectively named a "discharge muffler body."

A second muffler flange 162, which is coupled to the first discharge muffler part 150, can be provided on an end portion of the second muffler body 161. The second muffler flange 162 can be formed to be stepped from the second muffler body 161 such that an outer diameter of the second muffler flange 162 is greater than an outer diameter of the second muffler body 161. The second muffler flange 162 can be coupled to an outer portion of the first muffler flange 152.

A discharge guide device or discharge guide 300 for reducing pressure pulsation of the discharged refrigerant can be provided inside the discharge mufflers 150 and 160. The discharge guide device 300 can form the discharge fluid passage of the refrigerant, and can be supported by inner surfaces of the discharge mufflers 150 and 160. The discharge guide 300 can include one or more pipes, tubes, or the like.

The discharge hose 60 can extend from the second discharge muffler part 160 and be coupled to the discharge pipe 13. The discharge hose 60 can be coupled to the discharge part 165

Figure 6:
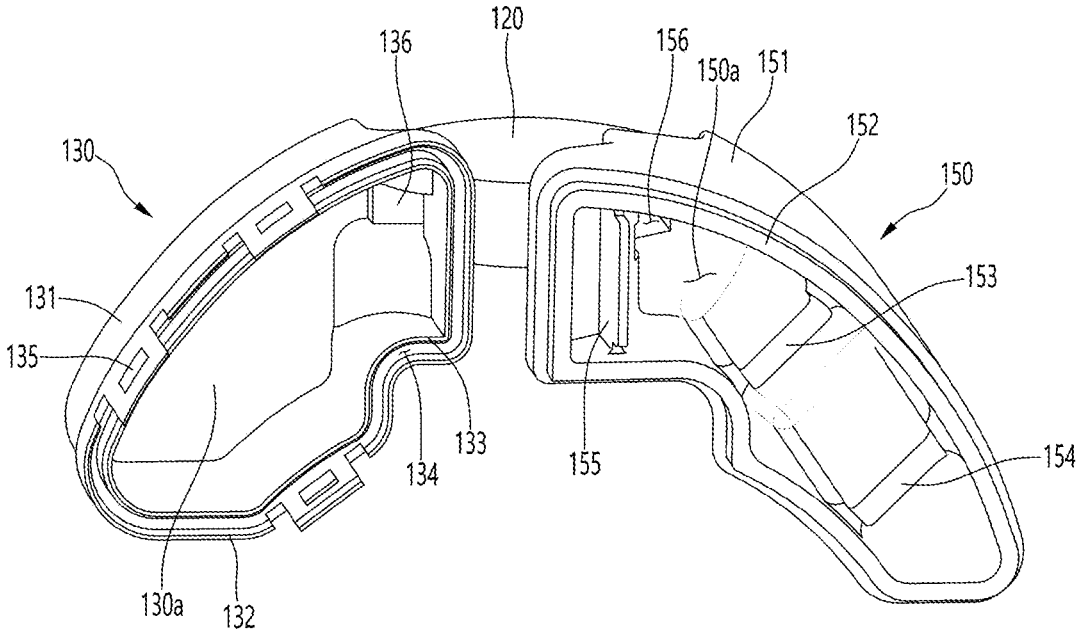
FIG. 6 is a view illustrating an example of a suction and discharge tank and first and third mufflers that are integrated with each other.

FIG. 6 is a view illustrating an example of a suction and discharge tank that is integrated with first and third mufflers.

Referring to FIG. 6, the muffler assembly 110 can include a tank assembly. For example, the tank assembly can include the suction and discharge tank 120, the first suction muffler part 130 provided at one side of the suction and discharge tank 120, and the first discharge muffler part 150 provided at an opposite side of the suction and discharge tank 120.

The first suction muffler part 130 and the first discharge muffler part 150 can be disposed in opposition to each other based on the suction and discharge tank 120.

The first suction muffler part 130 can include a first muffler body 131 to form a flowing space (that is, the suction fluid passage) for the refrigerant which is suctioned into the muffler assembly 110. The suction guide hole 136, which is to suction the refrigerant into the suction and discharge tank 120, can be formed in the first muffler body 131. The suction guide hole 136 can be formed in a part at which the first suction muffler part 130 is connected with the suction and discharge tank 120.

The first suction muffler part 130 can further include an inner wall 133 provided inside the first muffler body 131. The inner wall 133 can extend along an inner circumferential surface of the first muffler body 131 in parallel to the first muffler body 131.

The inner wall 133 can be spaced apart from the inner circumferential surface of the first muffler body 131. An insertion space 134 can be provided between the first muffler body 131 and the inner wall 133. An end portion of the second suction muffler part 140 can be inserted into the insertion space 134, such that the first and second suction mufflers 130 and 140 can be assembled.

The first discharge muffler part 150 can include a first muffler body 151 that forms a flowing space (that is, a discharge fluid passage 150*a*) for the refrigerant discharged from the suction and discharge tank 120. The discharge guide hole 156, which is to discharge the refrigerant from the suction and discharge tank 120, can be formed in the first muffler body 151. The discharge guide hole 156 can be formed in a part at which the first discharge muffler part 150 is connected with the suction and discharge tank 120.

The first discharge muffler part 150 can include at least one wall (see reference numerals 153, 154, and 155) provided in the discharge fluid passage 150*a* to divide the discharge fluid passage 150*a* into a plurality of discharge rooms.

In detail, the discharge muffler bodies 151 and 161, the walls 153, 154 and 155, and the discharge guide device 300 can define an inner space of the discharge muffler, which is to be divided into a plurality of discharge rooms.

The walls 153, 154, and 155 can be provided to protrude from the inner circumferential surface of the first discharge muffler part 150. For example, the walls 153, 154, and 155 can extend in the vertical direction when viewed based on FIG. 11.

The at least one wall can include a plurality of walls 153, 154, and 155

The plurality of walls 153, 154, and 155 can function as "reinforcing walls" that prevent the discharge mufflers 150 and 160 from being damaged by the high pressure applied when the discharged refrigerant flows.

The plurality of walls 153, 154, and 155 can include a first wall 153, a second wall 154 spaced apart from one side of the first wall 153, and a third wall 155 spaced apart from an opposite side of the first wall 153. The second and third walls 154 and 155 can be provided on opposite sides of the first wall 153.

The first to third walls 153, 154, and 155 can function as reinforcing walls to prevent the discharge mufflers 150 and 160 from being damaged under a higher-pressure environment of the discharge mufflers 150 and 160.

Figure 11:
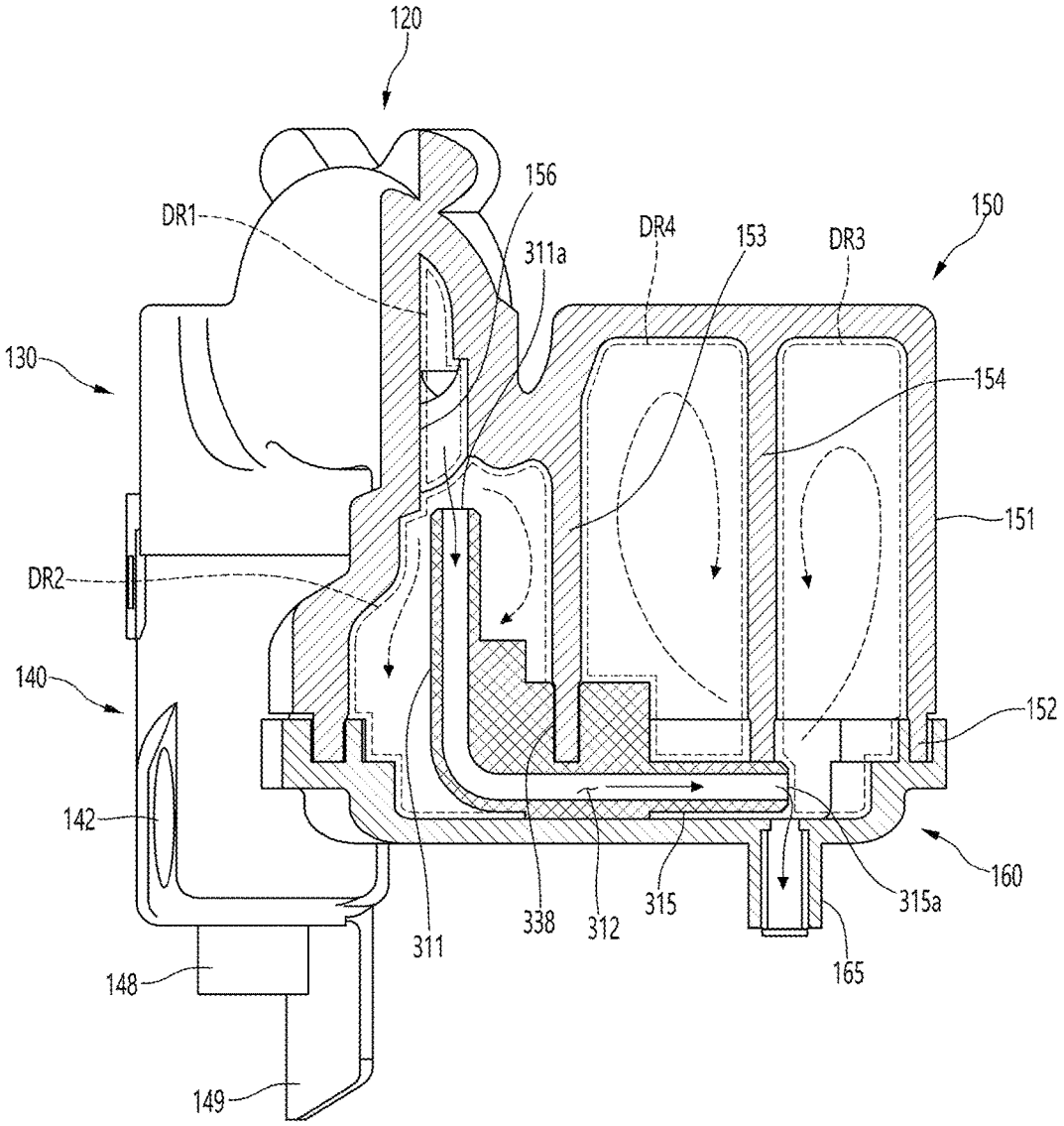
FIG. 11 is a cross sectional view taken along line 11-11' of FIG. 3.

The discharge chamber 123*b* of the suction and discharge tank 120 can form a primary discharge room "DR1" for the refrigerant (see FIG. 11).

A space between the first wall 153 and the first muffler body 151 can form a secondary discharge room "DR2" for the refrigerant (see FIG. 11).

A space between the second wall 154 and the first muffler body 151 can form a tertiary discharge room for the refrigerant. In detail, the space formed by the second wall 154 and the discharge muffler bodies 151 and 161 can be defined as the tertiary discharge room "DR3" for the refrigerant (see FIG. 11).

A space between the first wall 153 and the second wall 154 can form a quaternary discharge room for the refrigerant. In detail, the space formed by the first and second walls 153 and 154, the discharge muffler bodies 151 and 161, and the discharge guide device 300 can define the quaternary discharge room "DR4" (see FIG. 11) for the refrigerant.

The discharge guide device 300 can be arranged to be positioned in the spaces among the plurality of walls 153, 154, and 155. A main stream of the refrigerant discharged to the first discharge muffler part 150 through the discharge guide hole 156 passes through an inner fluid passage of the discharge guide device 300 and is discharged to the outside through the discharge part 165 of the second discharge muffler part 160.

In some implementations, a sub-stream of the refrigerant discharged to the first discharge muffler part 150 through the discharge guide hole 156 can be diffused into the secondary discharge room to the quaternary discharge room. The discharge pulsation of the refrigerant can be reduced by the main stream and the sub-stream of the refrigerant.

A second suction muffler part 140 can be assembled to the first suction muffler part 130. The second suction muffler part 140 can include a second muffler body 141 that forms a suction space for the refrigerant.

An assembly end portion 147 inserted into the insertion space 134 of the first suction muffler part 130 can be formed in the second muffler body 141. The assembly end portion 147 can be formed at an upper end portion of the second muffler body 141.

In some implementations, the end portion of the first suction muffler part 130 is placed on protrusion parts 215*a* and 215*b* of a suction guide device 200. Accordingly, when the first and second suction mufflers 130 and 140 are assembled, the first suction muffler parts 130 can press the upper end portion of the protrusion parts 215*a* and 215*b*. Accordingly, the suction guide device 200 can be stably supported by inner parts of the first and second suction mufflers 130 and 140

The suction guide device 200 can include a partition wall 210 to partition the inner space of the suction mufflers 130 and 140 into two spaces, and a guide pipe 220 forming a resonance hole 225 while extending in a direction of crossing the partition wall 210. The suction fluid passage for the refrigerant can be formed inside the guide pipe 220.

Hereinafter, the configuration and the mounting structure of the discharge guide device will be described with reference to accompanying drawings.

Figure 7:
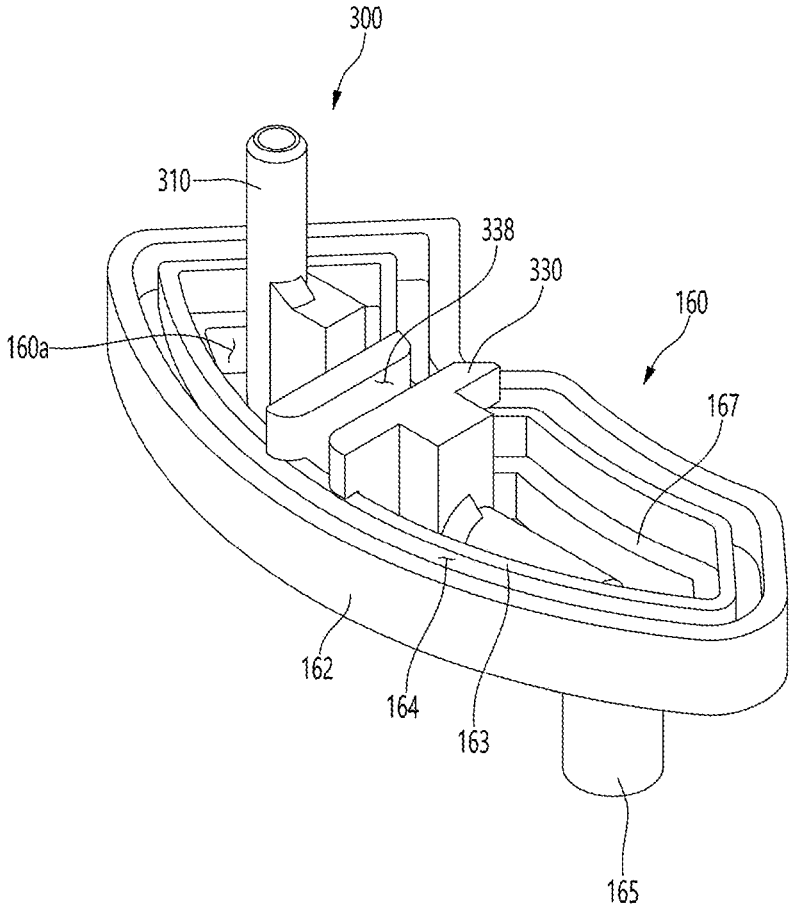
FIG. 7 is a perspective view illustrating an example of a second discharge muffler part coupled to a discharge guide device.
Figure 8:
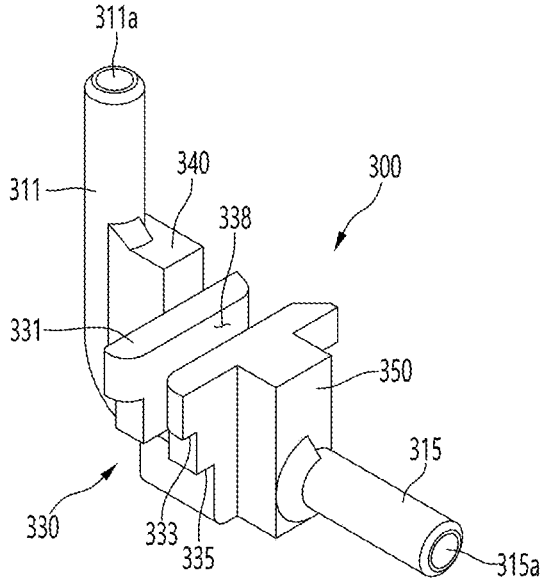
FIG. 8 is an exploded perspective view illustrating the second discharge muffler part and the discharge guide device.
Figure 8:
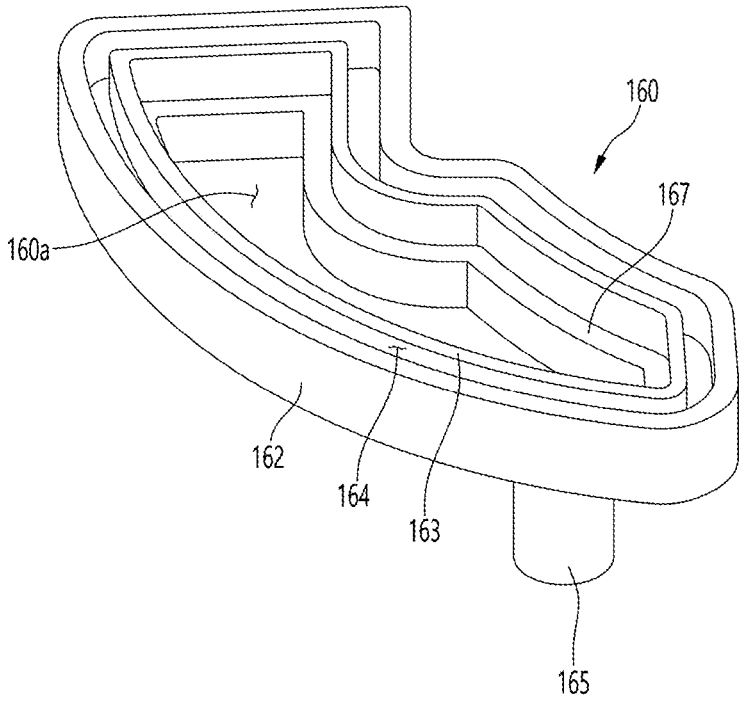
Figure 9:
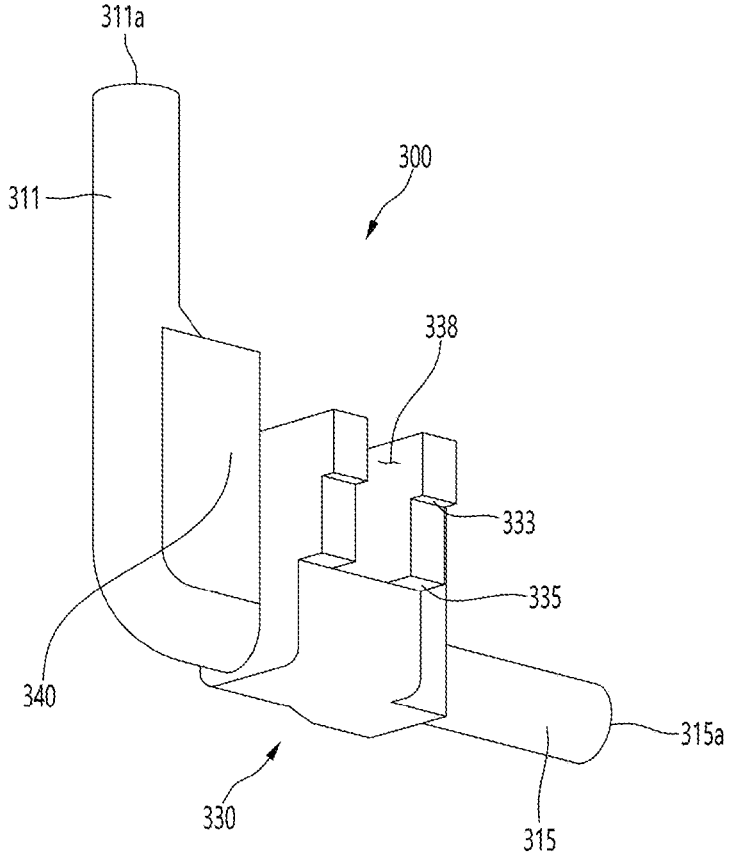
FIG. 9 is a perspective view illustrating the discharge guide device.
Figure 10:
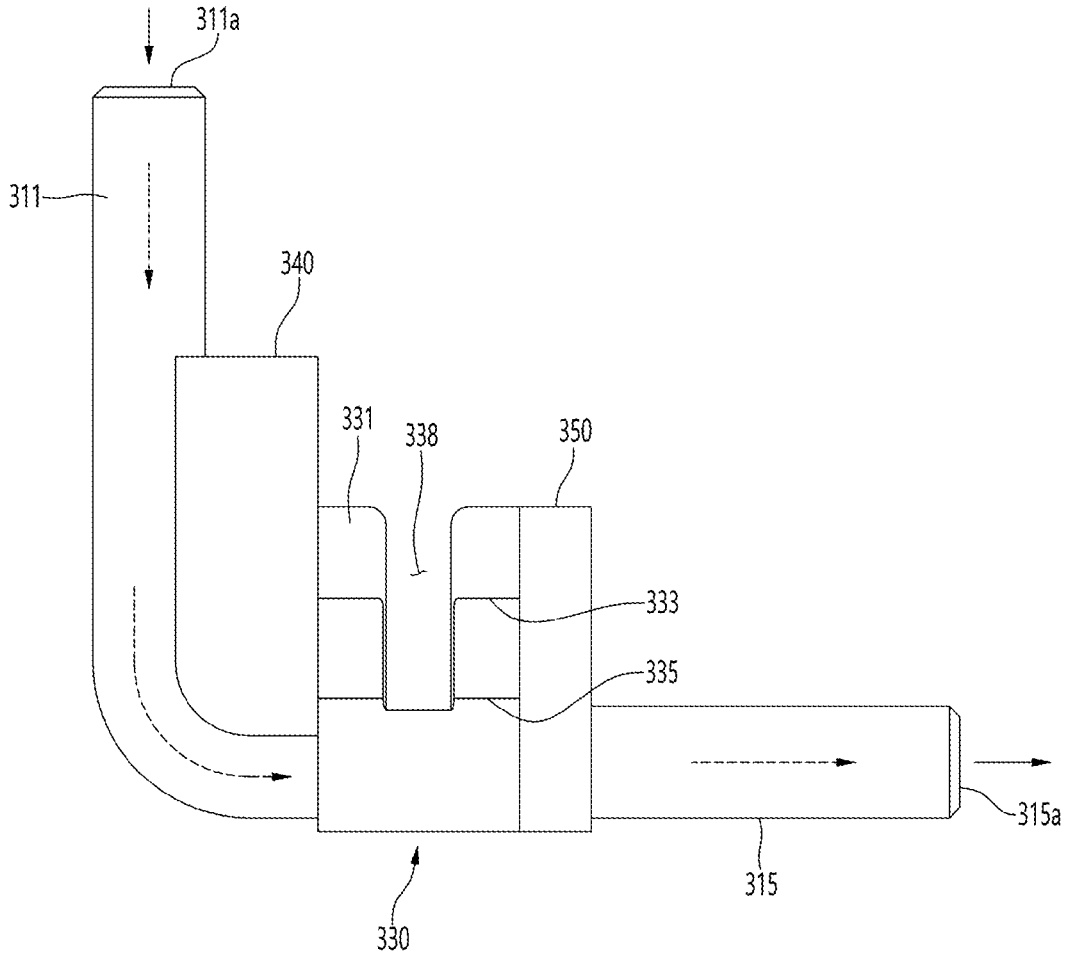
FIG. 10 is a perspective view illustrating the discharge guide device.

FIG. 7 is a perspective view illustrating an example of a second discharge muffler part coupled to a discharge guide device, and FIG. 8 is an exploded perspective view illustrating the second discharge muffler part and the discharge guide device. FIG. 9 is a perspective view illustrating an example configuration of the discharge guide device, and FIG. 10 is a perspective view illustrating an example configuration of the discharge guide device. FIG. 11 is a cross sectional view taken along line 11-11' of FIG. 3.

Referring to FIGS. 7 to 11, the second discharge muffler part 160 can be assembled to the first discharge muffler part 150. The first discharge muffler part 150 and the second discharge muffler part 160 can be coupled to each other through laser fusion. Accordingly, the coupling status of the discharge mufflers 150 and 160 forming the high-pressure environment can be firmly maintained.

The second discharge muffler part 160 can include a second muffler body 161 and a second muffler flange 162 that form a discharge fluid passage 160*a* for the refrigerant. The second muffler flange 162 can be coupled to an outer portion of the first muffler flange 152.

The second discharge muffler part 160 can further include an inner wall 163 provided inside the second muffler body 161. The inner wall 163 can extend along an inner circumferential surface of the second muffler body 161 in parallel to the second muffler body 161.

The inner wall 163 can be spaced apart from the inner circumferential surface of the second muffler body 161. An insertion space 164 can be provided between the second muffler body 161 and the inner wall 163. An end portion of the first discharge muffler part 150 is inserted into the insertion space 164, such that the first and second discharge mufflers 150 and 160 can be assembled.

A portion of the discharge guide device 300 can be supported by the upper end portion of the inner wall 163.

The second discharge muffler part 160 can further include an inner wall 163 provided to be stepped at an inside of the second muffler body 161. Another portion of the discharge guide device 300 can be supported by the upper end portion of the wall protrusion part 167. The upper end portion of the wall protrusion part 167 can be formed at a lower position than that of the upper end portion of the inner wall 163.

The inner wall 163 and the wall protrusion part 167 can be understood as components including a "first jaw" and a "second jaw," respectively, in that the inner wall 163 and the wall protrusion part 167 support the discharge guide device 300.

The discharge guide device 300 can be supported by the second discharge muffler part 160.

The discharge guide device 300 can be seated on a bottom surface of the second discharge muffler part 160.

The discharge guide device 300 can include a pipe 310 in which a fluid passage 312 (see FIG. 11; the inner fluid passage) for the refrigerant discharged to the discharge mufflers 150 and 160 is formed.

The pipe 310 can have a bending shape to guide the refrigerant, which is positioned at the upper side of the discharge mufflers 150 and 160, to the discharge part 165 positioned at the lower side of the discharge mufflers 150 and 160.

The pipe 310 can include a first pipe part 311 extending toward the discharge part 165 from the discharge guide hole 156 of the discharge mufflers 150 and 160. For example, the first pipe part 311 can extend in the vertical direction when viewed based on FIG. 7.

The first pipe part 311 can include a pipe inflow hole 311*a* to introduce the refrigerant, which is introduced into the discharge mufflers 150 and 160 through the discharge guide hole 156, into the pipe 310. The pipe inflow hole 311*a* can be formed in an end portion of the first pipe part 311, and can be disposed toward the discharge guide hole 156.

The pipe inflow hole 311*a* can be formed at a position closest to the discharge guide hole 156 of components of the discharge guide device 300.

The pipe 310 can include a second pipe part 315 bent from the first pipe part 311 to extend toward the discharge part 165. For example, the second pipe part 315 can extend in the horizontal direction when viewed based on FIG. 7.

The second pipe part 315 can include a pipe outflow hole 315*a* to discharge the refrigerant from the pipe 310. The pipe outflow hole 315*a* can be formed in an end portion of the second pipe part 315, and can be disposed toward the discharge part 165.

The pipe outflow hole 315*a* can be formed at a position closest to the discharge part 165 of components of the discharge guide device 300.

The refrigerant can be introduced into the first pipe part 311 through the pipe inflow hole 311*a*, can flow through the second pipe part 315, and can be discharged from the second pipe part 315 through the pipe outflow hole 315*a*.

The discharge guide device 300 can further include a fixing bracket 330 to support the pipe 310 with respect to the discharge mufflers 150 and 160. For example, the fixing bracket 330 can be provided at an outer portion the second pipe part 315. In other words, the fixing bracket 330 can surround a portion of the outer circumferential surface of the second pipe part 315.

The discharge guide device 300 can further include a first pipe connection part 340 to connect the first pipe part 311 to the fixing bracket 330. The first pipe part 311, the fixing bracket 330, and the first pipe connection part 340 can be integrally formed with each other.

The first pipe connection part 340 can be interposed between the first pipe part 311 and the fixing bracket 330. The supporting status of the first pipe part 311 with respect to the discharge mufflers 150 and 160 can be firmly maintained through the first pipe connection part 340.

The discharge guide device 300 can further include a second pipe connection part 350 to connect the second pipe part 315 to the fixing bracket 330. The second pipe part 315, the fixing bracket 330, and the second pipe connection part 350 can be integrally formed with each other.

The second pipe connection part 350 can be provided on a side surface of the second pipe part 315. In other words, the second pipe connection part 350 can be provided on an outer circumferential surface of the second pipe part 315. The supporting status of the second pipe part 315 with respect to the discharge mufflers 150 and 160 can be firmly maintained through the second pipe connection part 350.

The fixing bracket 330 can include a bracket body 331 having an insertion groove 338 into which the walls 153, 154, and 155 are inserted. The first and second pipe connection parts 340 and 350 can be provided at opposite sides of the bracket body 331.

The insertion groove 338 can be formed to be recessed downward from the top surface of the fixing bracket 330. For example, the first wall 153 can be inserted into the insertion groove 338.

As the first wall 153 is inserted into the insertion groove 338, the inner space of the discharge mufflers 150 and 160 can be partitioned by the first wall 153 and the discharge guide device 300. For example, the first wall 153 and the discharge guide device 300 can act to separate the secondary discharge room "DR2" and the quaternary discharge room "DR4" from each other.

The second wall 154 can be disposed adjacent to an upper portion of the second pipe part 315 or disposed in contact with the second pipe part 315

The second pipe part 315 and the second wall 154 do not completely separate the tertiary discharge room "DR3" from the quaternary discharge room "DR4," and the tertiary discharge room "DR3" and the quaternary discharge room "DR4" can communicate with each other through the surrounding space of the second pipe part 315.

The bracket body 331 can be supported by the second discharge muffler part 160. In detail, the bracket body 331 can include stepwise sections 333 and 335 supported by the second discharge muffler part 160.

The stepwise sections 333 and 335 can include a first stepwise section 333 supported by the inner wall 163 of the second discharge muffler part 160. The first stepwise section 333 can be stepped in a direction, in which the width of the bracket body 331 is reduced, from the outer surface of the bracket body 331.

The stepwise sections 333 and 335 can include a second stepwise section 335 supported by the wall protrusion part 167 of the second discharge muffler part 160. The second stepwise section 335 can be stepped in a direction, in which the width of the bracket body 331 is reduced, from the outer surface of the first stepwise section 333. Accordingly, the width of the second stepwise section 335 can be narrower than the width of the first stepwise section 333.

The first stepwise section 333 can be positioned above the second stepwise section 335, corresponding to that the inner wall 163 is positioned above the wall protrusion part 167.

Hereinafter, the procedure of assembling the discharge guide device 300 with the discharge mufflers 150 and 160 will be described in brief.

The first wall 153 is inserted into the insertion groove 338 of the discharge guide device 300, thereby assembling the discharge guide device 300 with the first discharge muffler part 150. Then, the second discharge muffler part 160 is assembled with the first discharge muffler part 150 such that the discharge guide device 300 is seated on the second discharge muffler part 160. The first and second discharge mufflers 150 and 160 are firmly coupled to each other by laser fusion.

Figure 12:
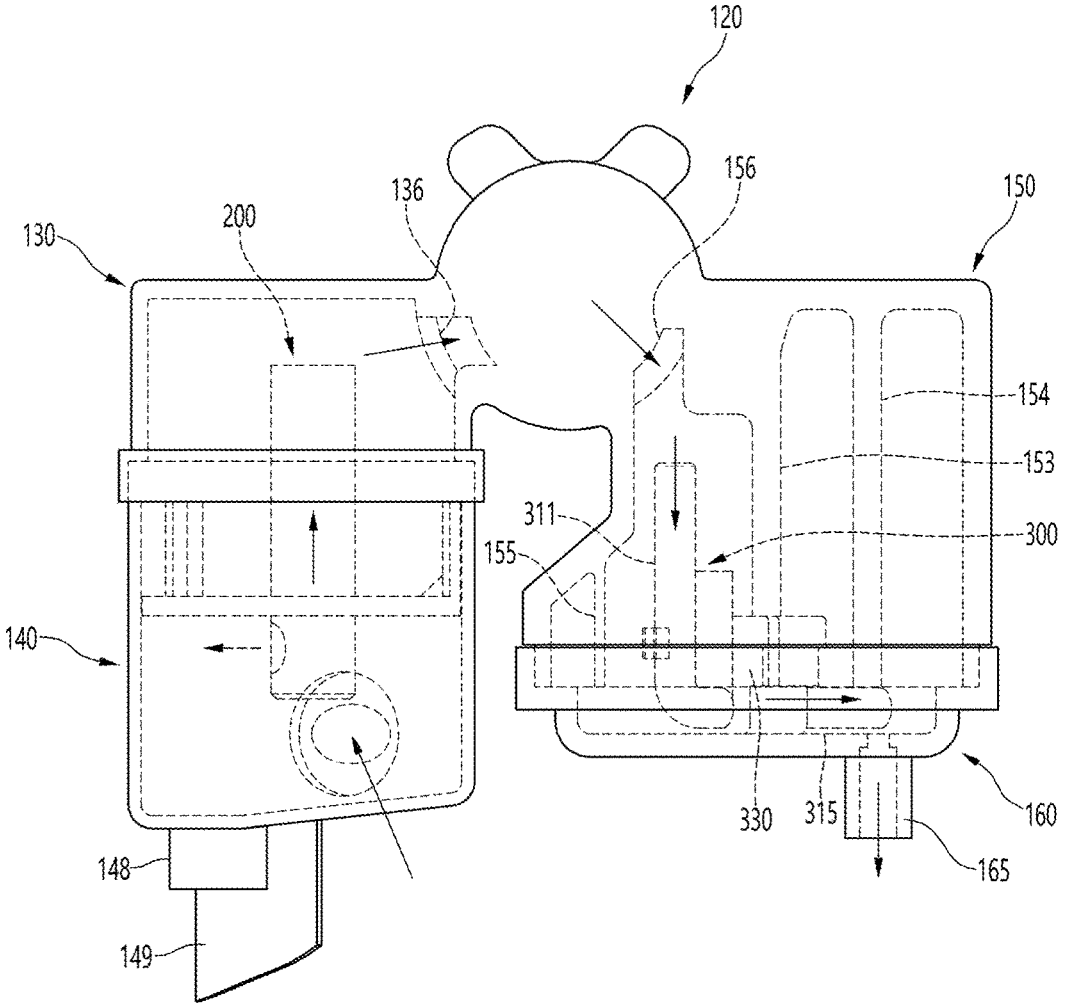
FIG. 12 is a view illustrating an example of a refrigerant flow in a discharge muffler.

FIG. 12 is a view illustrating an example of a refrigerant flow in the discharge muffler. Hereinafter, a refrigerant discharging action in the discharging mufflers 150 and 160 will be described in brief with reference to FIGS. 11 and 12 together.

When the reciprocating compressor 1 starts to drive, the refrigerant is introduced into the shell 10 through the suction pipe 12, and introduced into the suction mufflers 130 and 140 through the suction hole 142.

The refrigerant can be introduced into the second suction muffler part 140, and can flow through the guide pipe 220. In this case, a portion of the refrigerant is diffused into the inner space of the suction mufflers 130 and 140 through the resonance hole 225, and noise of the suctioned refrigerant can be reduced.

The refrigerant suctioned into the suction mufflers 130 and 140 is compressed in the cylinder 33 via the suction chamber 123*a* of the suction and discharge tank 120, and the compressed higher-pressure gas refrigerant can be discharged to the discharge mufflers 150 and 160 through the discharge chamber 123*b* of the suction and discharge tank 120 and the discharge guide hole 156.

The discharge chamber 123*b* can have the primary discharge room "DR1" for the refrigerant.

The main stream (marked with a solid arrow) of the refrigerant introduced into the discharge mufflers 150 and 160 can be introduced into the pipe 310 through the pipe inflow hole 311*a*. The refrigerant can be discharged through the pipe outflow hole 315*a* via the first pipe part 311 and the second pipe part 315.

The pressure pulsation can be reduced in the procedure in which the refrigerant flows through the first and second pipe parts 311 and 315.

The refrigerant can be discharged through the discharge part 165 of the discharge mufflers 150 and 160, and can flow through the discharge hose 60.

The secondary discharge room "DR2" can be formed inside the discharge mufflers 150 and 160. The secondary discharge chamber "DR2" can be defined as an external space of the discharge guide device 300, of spaces formed by the first wall 153 and the discharge muffler bodies 151 and 161.

The secondary discharge chamber "DR2" can be separated from the quaternary discharge room "DR4" by the first wall 153 and the discharge guide device 300

A sub-stream (marked with a dotted arrow) of the discharge refrigerant other than the main stream can be diffused into the secondary discharge room "DR2."

The tertiary discharge room "DR3" can be formed inside the discharge mufflers 150 and 160. The tertiary discharge room "DR3" can include a space defined by the second wall 154 and the discharge muffler bodies 151 and 161. The sub-stream of the refrigerant other than the main stream, which is discharged through the pipe outflow hole 315*a* of the pipe 310, can be spread into the tertiary discharge room "DR3."

The quaternary discharge room "DR4" can be formed inside the discharge mufflers 150 and 160. The quaternary discharge room "DR4" can include a space defined by the first and second walls 153 and 154, the discharge muffler bodies 151 and 161, and the discharge guide device 300.

The quaternary discharge room "DR4" can communicate with the tertiary discharge room "DR3." The communicating space can be a surrounding space (a front-rear space when viewed from the drawing) of the second pipe part 315.

The sub-stream of the refrigerant other than the main stream, which is discharged through the pipe outflow hole 315*a* of the pipe 310, can be spread into the quaternary discharge room "DR4" through the tertiary discharge room "DR3."

As described above, the refrigerant introduced into the discharge mufflers 150 and 160 has the main stream into the pipe 310 and sub-streams into the secondary discharge room "DR2" to the quaternary discharge room "DR4." In this procedure, the pressure pulsation can be reduced.

Figure 13:
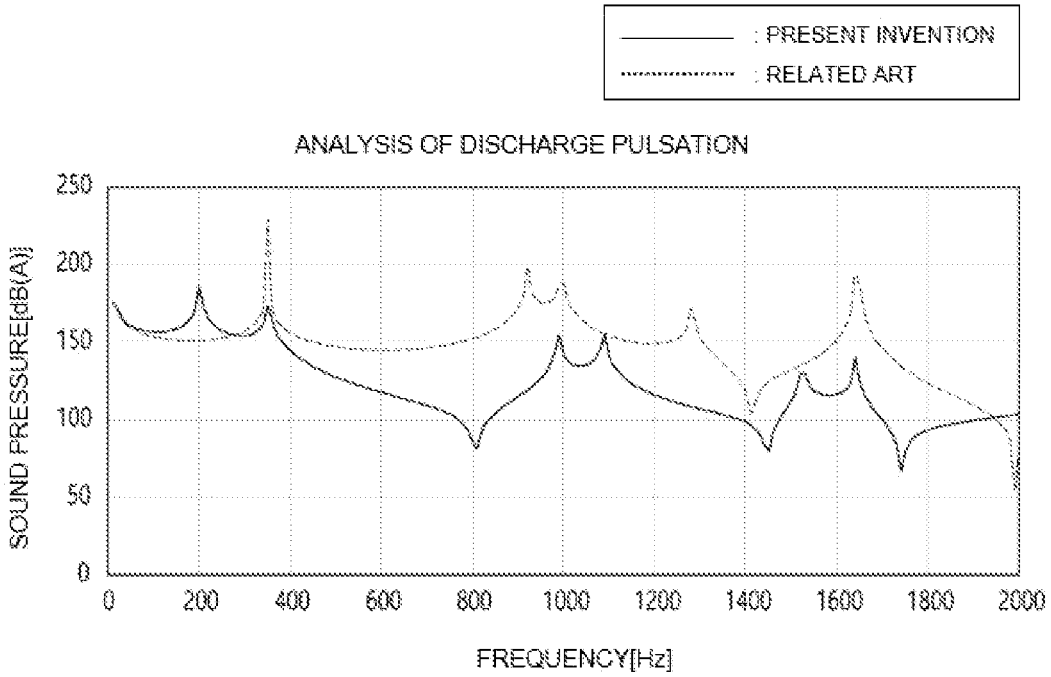
FIG. 13 is a graph illustrating an example of an experimental result showing an effect of reducing a pulsation with the discharge muffler having the discharge guide device.

FIG. 13 is a graph illustrating an example of an experimental result showing an effect of reducing a pulsation with the discharge muffler having the discharge guide device. Specifically, FIG. 13 illustrates the comparison between a related art and the present disclosure in terms of the intensity of sound pressure generated in a frequency range having a specific band. The frequency range having the specific band shows 2,000 Hz or less.

The related art relates to a technology of using a discharge muffler without a discharge guide device, and the present disclosure relates to a technology in which the discharge guide device 300 described above is provided inside the discharge mufflers 150 and 160.

The intensity of the sound pressure generated from the discharge muffler according to the present disclosure can be lower than the intensity of the sound pressure generated from the discharge muffler according to the related art, throughout the whole frequency range.

According to the experimental result, as the discharge guide device is provided in the discharge muffler according to the preset disclosure, the pressure pulsation of the discharged refrigerant can be reduced.

What is claimed is:

1. A reciprocating compressor comprising:

a cylinder that defines a compressing space; and a discharge muffler configured to receive refrigerant compressed in the cylinder and to discharge the refrigerant, the discharge muffler comprising:

a discharge muffler body that defines a discharge space configured to receive the refrigerant from the cylinder, the discharge muffler body comprising a wall that protrudes from an inner circumferential surface of the discharge muffler body, and a discharge guide supported by the discharge muffler body and coupled to the wall, wherein the discharge guide comprises:

a pipe that defines (i) a pipe inflow hole configured to receive the refrigerant from the discharge space and (ii) a pipe outflow hole configured to discharge the refrigerant, and a fixing bracket that couples the pipe to the discharge muffler body.

2. The reciprocating compressor of claim 1, wherein the pipe comprises:

a first pipe part that extends in a first direction; and a second pipe part that extends from the first pipe part in a second direction that is different from the first direction.

3. The reciprocating compressor of claim 2, wherein the discharge muffler body defines a discharge guide hole configured to introduce the refrigerant from the cylinder into the discharge muffler, and wherein the pipe inflow hole is defined at the first pipe part and faces the discharge guide hole.

4. The reciprocating compressor of claim 3, wherein the discharge muffler body further defines a discharge part configured to discharge the refrigerant from the discharge muffler, and wherein the pipe outflow hole is defined at the second pipe part and faces the discharge part.

5. The reciprocating compressor of claim 4, wherein the first direction is a vertical direction, and the second direction is a horizontal direction, and wherein the discharge guide hole is spaced apart from the discharge part and defined above the discharge part in the vertical direction.

6. The reciprocating compressor of claim 1, wherein the fixing bracket comprises a bracket body that defines an insertion groove coupled to the wall, the bracket body having at least one stepwise section supported by the discharge muffler body.

7. The reciprocating compressor of claim 6, wherein the at least one stepwise section comprises:

a first stepwise section recessed from an outer surface of the bracket body, the first stepwise section defining a first step width that is less than an outer width of the bracket body; and a second stepwise section recessed relative to the first stepwise section, the second stepwise section defining a second step width that is less than the first step width.

8. The reciprocating compressor of claim 7, wherein the discharge muffler body comprises:

an inner wall that is spaced apart from an outer surface of the discharge muffler body, the inner wall including a first jaw that supports the first stepwise section; and a wall protrusion part that is stepped inward relative to the inner wall, the wall protrusion part including a second jaw that supports the second stepwise section.

9. The reciprocating compressor of claim 1, further comprising:

a tank that is disposed at one side of the cylinder and defines a discharge chamber configured to receive the refrigerant from the cylinder and to supply the refrigerant to the discharge space, wherein the discharge chamber has a primary discharge room configured to carry the refrigerant received from the cylinder.

10. The reciprocating compressor of claim 9, wherein the wall divides the discharge space into one or more discharge rooms that are configured to receive the refrigerant from the primary discharge room.

11. The reciprocating compressor of claim 1, wherein the wall comprises a first wall and a second wall that are spaced apart from each other, and wherein the first wall and the second wall divide the discharge space into a plurality of discharge rooms that are configured to carry the refrigerant received from the cylinder.

12. The reciprocating compressor of claim 11, wherein the plurality of discharge rooms comprise:

a secondary discharge room defined between the first wall and the discharge muffler body.

13. The reciprocating compressor of claim 12, wherein the plurality of discharge rooms further comprise:

a tertiary discharge room defined between the second wall and the discharge muffler body; and a quaternary discharge room defined between the first wall and the second wall, the quaternary discharge room being in fluid communication with the tertiary discharge room.

14. The reciprocating compressor of claim 13, wherein the first wall separates the secondary discharge room from the quaternary discharge room.

15. The reciprocating compressor of claim 1, wherein the discharge muffler body comprises:

a first muffler body that defines a discharge guide hole configured to introduce the refrigerant from the cylinder into the discharge muffler; and a second muffler body that is coupled to the first muffler body and defines a discharge part configured to discharge the refrigerant from the discharge muffler, the second muffler body having a bottom surface that supports the discharge guide.

16. The reciprocating compressor of claim 1, further comprising:

a tank disposed between the cylinder and the discharge muffler, the tank defining a discharge chamber configured to receive the refrigerant from the cylinder and to discharge the refrigerant to the discharge space; and a suction muffler disposed at one side of the tank and configured to supply the refrigerant to the tank.

17. The reciprocating compressor of claim 16, wherein the tank is disposed between the suction muffler and the discharge muffler, the tank facing the cylinder and connecting the suction muffler to the discharge muffler.

18. The reciprocating compressor of claim 16, wherein the tank further defines a suction chamber configured to receive the refrigerant from the suction muffler and to supply the refrigerant to the cylinder.

19. The reciprocating compressor of claim 18, further comprising:

a shell that defines an enclosed space that accommodates the cylinder, the discharge muffler, the suction muffler, the tank, and the refrigerant, wherein the suction muffler defines a suction hole configured to introduce the refrigerant in the enclosed space into the suction muffler.

20. The reciprocating compressor of claim 19, wherein the suction muffler further defines a suction guide hole configured to supply the refrigerant in the suction muffler to the cylinder.

* * * * *